US006510900B2

(12) United States Patent
Dallas

(10) Patent No.: US 6,510,900 B2
(45) Date of Patent: Jan. 28, 2003

(54) SEAL ASSEMBLY FOR DUAL STRING COIL TUBING INJECTION AND METHOD OF USE

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 155 days.

(21) Appl. No.: 09/780,190

(22) Filed: Feb. 8, 2001

(65) Prior Publication Data

US 2002/0104662 A1 Aug. 8, 2002

(51) Int. Cl.[7] ..... E21B 19/22

(52) U.S. Cl. ..... 166/384; 166/77.3; 166/84.2; 166/97.5; 166/385

(58) Field of Search ..... 166/384, 385, 166/84.2, 84.1, 77.1, 77.2, 77.3, 97.5; 277/323, 322

(56) References Cited

U.S. PATENT DOCUMENTS 2,153,852 A * 4/1939 Tschappat ..... 166/97.5
3,253,835 A * 5/1966 Brown ..... 166/97.5
4,284,142 A 8/1981 Kirkland ..... 166/344
4,474,236 A 10/1984 Kellett ..... 166/250
4,940,095 A 7/1990 Newman ..... 166/378
5,775,420 A * 7/1998 Mitchell et al. ..... 166/313
5,944,099 A * 8/1999 Sas-Jaworsky ..... 166/77.2
5,960,885 A 10/1999 Edwards et al. ..... 166/345
6,145,596 A * 11/2000 Dallas ..... 166/379

* cited by examiner

*Primary Examiner*—Hoang Dang
(74) *Attorney, Agent, or Firm*—Nelson Mullins Riley & Scarborough, LLP

(57) ABSTRACT

A seal assembly for dual string coil tubing injection into a subterranean well includes a seal plate having first and second bores with annular seals for providing a high-pressure fluid seal around first and second coil tubing strings inserted through the respective bores. The seal plate is adapted to be connected directly to a wellhead, or a lubricator if a downhole tool is connected to either one, or both of the first and second coil tubing strings. The seal assembly further includes passages for supplying lubricant to the first and second annular seals to lubricate the respective seals while the respective first and second coil tubing strings are injected into and extracted from the wellhead.

20 Claims, 4 Drawing Sheets

SEAL ASSEMBLY FOR DUAL STRING COIL TUBING INJECTION AND METHOD OF USE

FIELD OF THE INVENTION

The present invention relates generally to apparatus for performing operations in subterranean wells. More specifically, the invention relates to a seal assembly for dual string coil tubing injection into wells, and a method of preventing fluid leakage during injection of two coil tubing strings into wells for certain downhole operations.

BACKGROUND OF THE INVENTION

Continuous reeled pipe, generally known within the energy industry as coil tubing string, has been used for many years. It is much faster to run into and out of a well casing than conventional jointed tubing.

Typically the coil tubing string is inserted into the wellhead through a lubricator assembly or a stuffing box because there is a pressure differential between the well bore and atmosphere. The pressure differential may have been naturally or artificially created and serves to produce oil or gas, or a mixture thereof, from the pressurized well.

The coil tubing strings are run into and out of well bores using coil tubing string injectors, which force the coil tubing strings into the wells through a lubricator assembly or stuffing box to overcome the well pressure until the weight of the coil tubing string exceeds the force applied by the well pressure that acts against the cross-sectional area of the coil tubing string. However, once the weight of the coil tubing string overcomes the pressure, the coil tubing string must be supported by the injector. The process is reversed as the coil tubing string is removed from the well.

A method for running dual jointed tubing strings into and out of wells is described in U.S. Pat. No. 4,474,236, entitled METHOD AND APPARATUS FOR REMOTE INSTALLATION OF DUAL TUBING STRINGS IN A SUBSEA WELL which issued to Kellett on Oct. 2, 1984. Kellett describes a method and apparatus for completing a well using jointed production and service strings of different diameters. The method includes steps of running the production string on a main tubing string hanger while maintaining control with a variable bore blowout preventer, and then running the service string into the main tubing string hanger while maintaining control with a dual bore blowout preventer, with the two jointed tubing strings oriented thereto.

The use of coiled tubing for various well treatment processes such as fracturing, acidizing and gravel packing is well known. Typically, several thousand feet of flexible, seamless tubing is coiled onto a large reel that is mounted on a truck or skid. A coiled tubing injector with a chain-track drive, or some equivalent, is mounted above the wellhead and the coiled tubing is fed to the injector for injection into the well. The coil tubing string is straightened as it is removed from the reel by a coil tubing guide that aligns the coiled tubing string with the well bore and the injector mechanism.

Although the use of dual string coil tubing for well servicing and production is known, the prior art fails to teach a method or apparatus for injecting two coil tubing strings into a well bore at the same time. Recent developments in well completion and well workover have, however, demonstrated the utility of using two coil tubing strings concurrently for many downhole operations. The difficulty with injecting dual string coil tubing into a well bore is the proximity of the respective coil tubing strings and the consequent lack of working space to deploy a pair of prior art coil tubing string injector assemblies mounted above the wellhead. This problem is solved by the Applicant with a coil tubing string injector assembly adapted to simultaneously inject dual string coil tubing into a well bore, as disclosed in the Applicant's copending U.S. patent application Ser. No. 09/779,087 entitled DUAL STRING COIL TUBING INJECTOR ASSEMBLY which is filed concurrently herewith and incorporated herein by reference.

Another problem associated with the injection of dual string coil tubing into a well bore is the prevention of fluid leakage during the injection of the dual string coil tubing, especially when a long downhole tool is connected to one or both of the coil tubing strings. Downhole tools typically have a larger diameter than the coil tubing string, and cannot be plastically deformed, which presents certain difficulties. It is known in the art to overcome these difficulties while injecting a single coil tubing string. For example, U.S. Pat. No. 4,940,095, entitled DEPLOYMENT/RETRIEVAL METHOD AND APPARATUS FOR WELL TOOLS USED WITH COILED TUBING, which issued to Newman on Jul. 10, 1990, discloses a method of inserting a well service tool connected to a coiled tubing string, which avoids the high and/or remote mounting of a heavy coiled tubing injector drive mechanism. A closed-end lubricator is used to house the tool until it is run down through a blowout preventer connected to a top of the well. The pipe rams of the blowout preventer are closed around the tool to support it while a tubing injector is mounted to the wellhead and the coil tubing string is connected to the tool. The blowout preventer is then opened and the coil tubing string injector is used to run the tool into the well. Newman fails to address the use of dual string coil tubings, however.

There is therefore a need for an apparatus and method for prevention of fluid leakage during the injection of dual string coil tubing into a well bore.

SUMMARY OF THE INVENTION

It is one object of the present invention to provide a seal assembly for dual string coil tubing injection into a well bore.

It is another object of the invention to provide a method for prevention of fluid leakage during the injection of dual string coil tubing into a well bore for a downhole operation.

In accordance with one aspect of the invention, a seal assembly for dual string coil tubing injection into a subterranean well comprises a seal plate adapted to be connected to a wellhead. The seal plate has a top surface, a bottom surface and first and second bores extending through the seal plate between the top and bottom surfaces. The first bore receives a first annular seal adapted to slidingly and sealingly surround a first coil tubing string extending therethrough, and the second bore receives a second annular seal adapted to slidingly and sealingly surround a second coil tubing string extending therethrough. Passages are provided for directing lubricating fluid to the first and second annular seals to lubricate the respective first and second coil tubing strings while the respective first and second coil tubings are injected into and extracted from the wellhead.

The seal plate includes means for mounting the seal assembly directly to a top of the wellhead, or for mounting the seal assembly to a lubricator that is connected to a top of the wellhead. The seal plate includes grooves for positioning an annular seal between the top end of the lubricator or the top end of the wellhead and the bottom surface of the seal plate.

In accordance with another aspect of the invention, a method of preventing fluid leakage during injection of a dual string coil tubing into a subterranean well for downhole operation is provided. The method comprises steps of inserting first and second coil tubing strings through a dual string coil tubing injector and respective annular seals in a seal plate; suspending the seal plate and the first and second coil tubing strings over a wellhead installed on the well; providing a sealed chamber between the seal plate and a closed blind ram of a blowout preventer of the wellhead; opening the blind ram of the blowout preventer; and injecting the first and second coil tubing strings using the dual string coil tubing injector while injecting lubricant to the annular seals in the seal plate.

A downhole tool may be connected to a free end of at least one of the first and second coil tubing strings. If so, the sealed chamber provided in step (c) sealingly contains the downhole tool. The sealed chamber provided in step (c) may be provided with a lubricator respectively connected to a top of the wellhead and the seal plate. When a downhole tool is not required, the sealed chamber provided in step (c) is alternatively provided by sealingly connecting the seal plate to the top of the wellhead while free ends of both first and second coil tubing strings are inserted into the wellhead above closed blind rams of a blowout preventer. A dual bore blowout preventer is preferably provided below the blowout preventer having the blind rams, and the dual bore blowout preventer is closed around the first and second coil tubing strings after the downhole tool or the free ends of the first and second coil tubing strings are inserted downwards past the pipe rams of the dual bore blowout preventer.

The present invention together with the dual string coil tubing injector assembly described in the Applicant's copending patent application enables downhole operations requiring a downhole tool connected to each of first and second coil tubing strings, or a downhole operation requiring two coil tubing strings serving different functions or serving similar functions at different depths in the well bore.

Other features and advantages of the invention will be better understood with reference to preferred embodiments described below.

BRIEF DESCRIPTION OF THE DRAWINGS

Having thus generally described the nature of the present invention, reference will now be made by way of illustration only to the accompanying drawings, in which.

It will be noted that throughout the appended drawings, like features are identified by like reference numerals.

DETAILED DESCRIPTION OF THE PREFERRED EMBODIMENT

Figure 1:
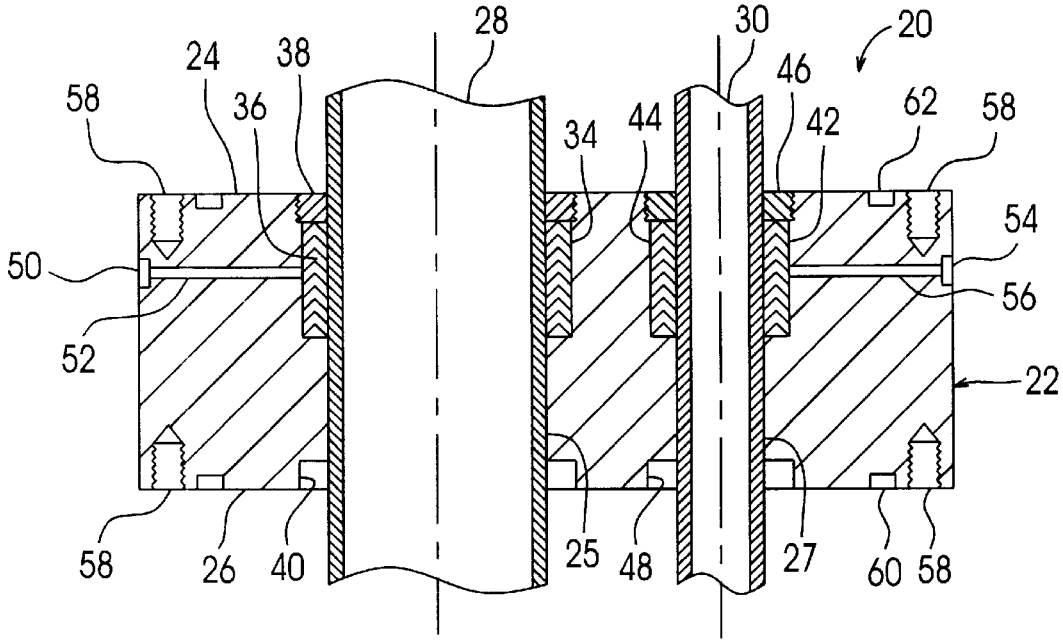
FIG. 1 is a cross-sectional view of a seal assembly in accordance with the present invention, illustrating seals around dual string coil tubing during the injection thereof.
Figure 2:
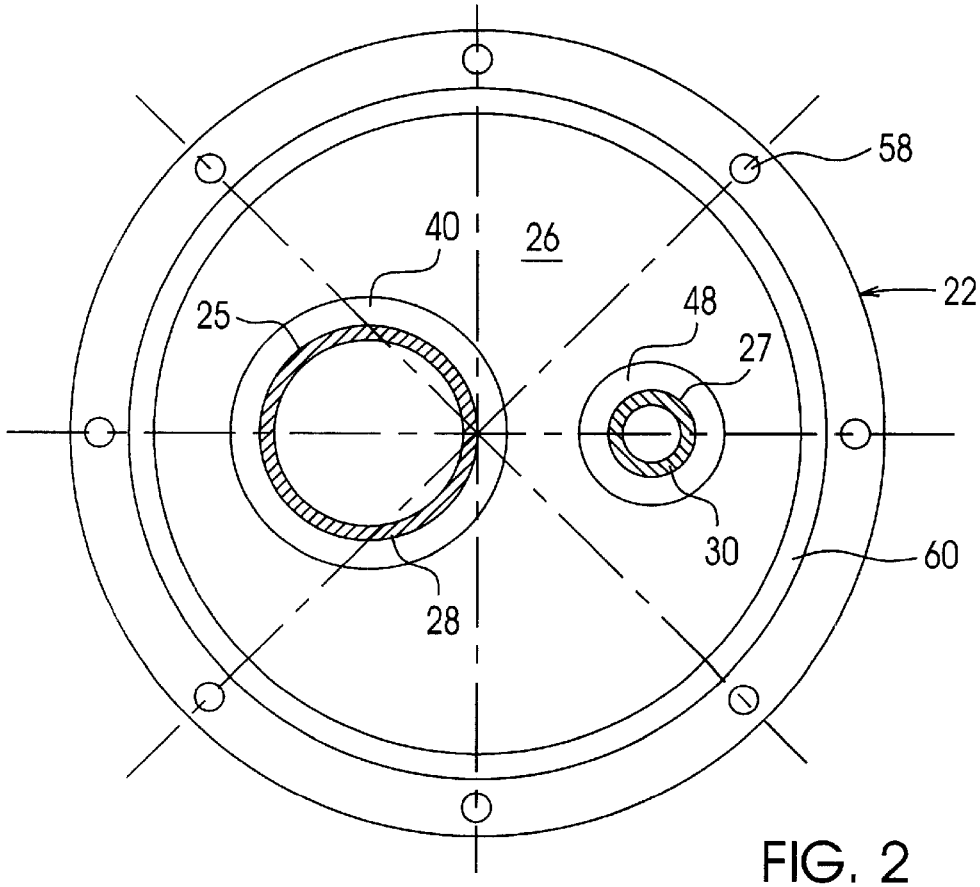
FIG. 2 is a bottom plan view of the seal assembly shown in FIG. 1.

FIGS. 1 and 2 illustrate a seal assembly in accordance with a preferred embodiment of the invention, generally indicated by reference numeral 20. The seal assembly 20 includes a circular seal plate 22 having a diameter conforming to a top flange of a standard wellhead. The seal plate 22 has a top surface 24, a bottom surface 26, and first and second bores 25 and 27 extending between the top surface 24 and the bottom surface 26 in a parallel relationship for receiving first and second coil tubing strings 28 and 30.

The first bore 25 has a diameter slightly greater than the outer diameter of the first coil tubing string 28 to permit the first coil tubing string 28 to be inserted therethrough. The first bore 25 includes a packing chamber 34 having a substantial axial length and a diameter substantially greater than the outer diameter of the first coil tubing string 28 to form an annulus for receiving an annular seal 36 to provide a high-pressure fluid seal between the first coil tubing string 28 and the seal plate 22. The annular seal 36 preferably includes packing rings of brass, rubber and fabric which have an inner diameter equal to the outer diameter of the first coil tubing string 28. The annular seal 36 is replaceable and is retained in annulus by a retainer nut 38 that is threadably engaged with the seal plate 22 at a top end of the bore 25. At the bottom end of the first bore 25, there is an annular recess 40 having a relatively short axial length and a diameter significantly greater than the outer diameter of the first coil tubing string 28.

Similarly, the second bore 27 has a packing chamber 42 having a substantial axial length and a diameter substantially greater than the outer diameter of the second coil tubing string 30. The packing chamber 42 defines an annulus surrounding the second coil tubing string 30 for receiving a second annular seal 44 to provide a high-pressure fluid seal between the seal plate 22 and the second coil tubing string 30. The second annular seal 44 preferably includes packing rings of brass, rubber and fabric that have an inner diameter equal to the outer diameter of the second coil tubing string 30. The second annular seal 44 is replaceable and is retained in the annulus by a second retainer nut 46 that threadably engages the seal plate 22 at the top end of the packing chamber 42. The second bore 27 also includes an annular recess 48 having a relatively short axial length and a diameter substantially greater than the outer diameter of the second coil tubing string 30.

When injecting or extracting coil tubing strings, the frictional force of the tubing moving past the fluid seals 36, 44 produces heat that can damage the seals. In order to reduce the frictional force, lubrication of the annular seals 36 and 44 is desirable. Therefore, at least one lubrication port 50 is preferably provided on the periphery of the seal plate 22. Fluid communication between the lubrication port 50 and the packing chamber 34 is provided by a radial passage 52. The lubrication port 50 is adapted to be connected to a pressurized lubricant source, such as an oil or grease pump (not shown), so that pressurized lubricant can be pumped at a slow rate into the packing chamber 34 of the first bore 25 to provide continuous lubrication between the annular seal 36 and the first coil tubing string 28 during the injection or extraction of the first coil tubing string 28.

Similarly, at least one lubrication port 54 is provided on the periphery of the seal plate 22, and fluid communication with the packing chamber 42 is provided by a radial passage 56 to deliver lubricant at a slow rate to the second annular seal 44, while the second coil tubing string 30 is injected or extracted.

A plurality of threaded mounting bores 58 are circumferentially spaced apart from one another and are provided on the both top and bottom surfaces 24 and 26 for connection of other equipment. For example, the threaded mounting bores 58 on the bottom surface 26 of the seal plate 22 may receive bolts to connect the seal plate 22 to the top flange of a wellhead, and the threaded mounting bores 58 on the top surface 24 of the seal plate 22 may receive bolts to connect a dual string coil tubing injector assembly to the top of the seal plate 22. An annular groove 60 is provided in the bottom surface 26 of the seal plate 22 for retaining a gasket (not shown) to provide a seal between the seal plate 22 and, for example, the top flange of a wellhead. Similarly, an annular groove 62 is provided on the top surface 24 of the seal plate 22 for retaining a gasket (not shown) to provide a seal between the seal plate 22 and equipment connected to the top surface 24 of the seal plate 22, if a seal therebetween is required.

In accordance with the invention, a method of using the seal assembly 20 shown in FIGS. 1 and 2 to prevent fluid leakage during the injection of the dual string coil tubing into a well bore to prepare a subterranean well for servicing is described with reference to FIGS. 3–7. The method relates to a downhole tool connected to both first and second coil tubing strings 28 and 30 and therefore, synchronous injection of the first and second coil tubing strings 28 and 30 is required. For example, a perforating gun incorporated with a stimulation fluid nozzle permitting perforation and stimulation processes to be completed in one injection of the tool into the well bore requires a first coil tubing string to be connected for delivery of a stimulation fluid and a second coil tubing string or wireline to be connected for housing electrical conductors for detonating perforating charges carried by the tool, which is described in the Applicant's co-pending United States Patent application, entitled METHOD AND APPARATUS FOR PERFORATING AND STIMULATING OIL WELLS, filed on Nov. 7, 2000 under Ser. No. 09/707,739, the specification of which is incorporated herein by reference.

Figure 3:
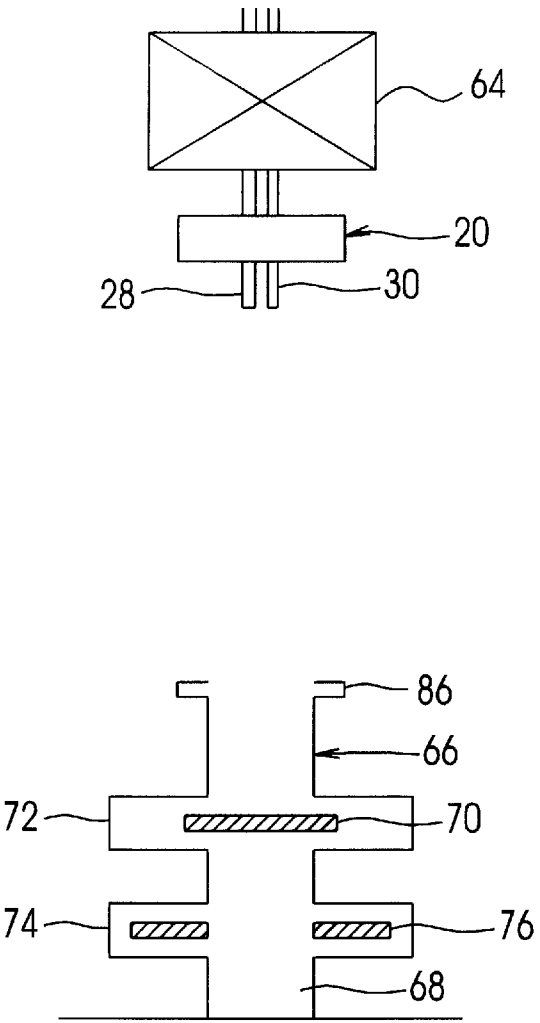

As shown in FIG. 3, the first and second coil tubing strings 28 and 30 are inserted through a dual string coil tubing injector assembly 64 which is supported by a frame structure (not shown) above a wellhead 66. The dual string coil tubing injector assembly 64 is aligned with the wellhead 66 and is positioned above the wellhead 66 so that there is enough space between the dual string coil tubing injector assembly 64 and the wellhead 66 for manipulation during the injection process described below. The first and second coil tubing strings 28 and 30 are driven through the injector assembly 64 and inserted through the seal assembly 20. The well bore 68 is sealed from fluid communication with atmosphere by the closure of blind rams 70 of a blowout preventer 72.

Figure 4:
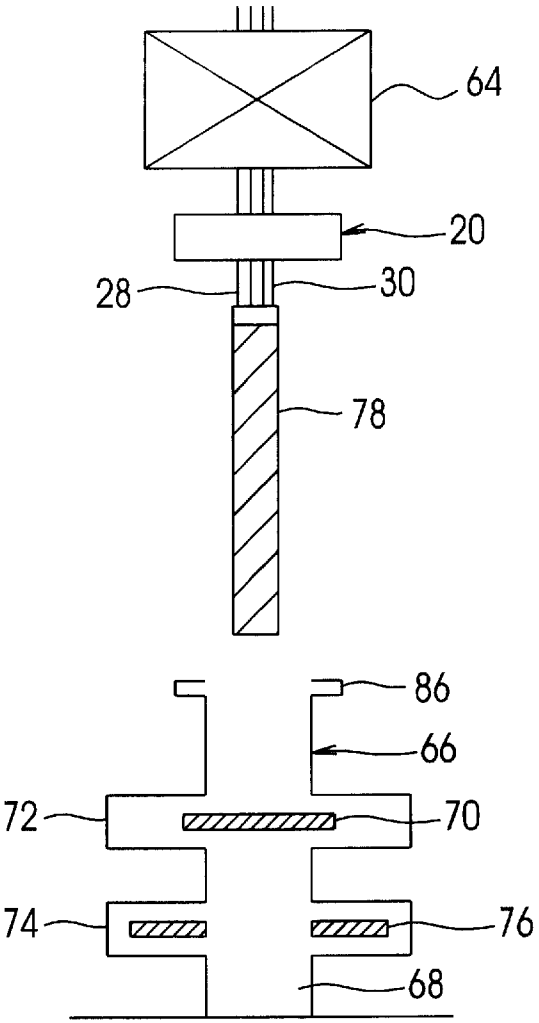
FIGS. 3–7 are schematic diagrams, illustrating a method of using the seal assembly shown in FIG. 1 to inject first and second coil tubing strings that are connected to a downhole tool into a well bore.
Figure 7:
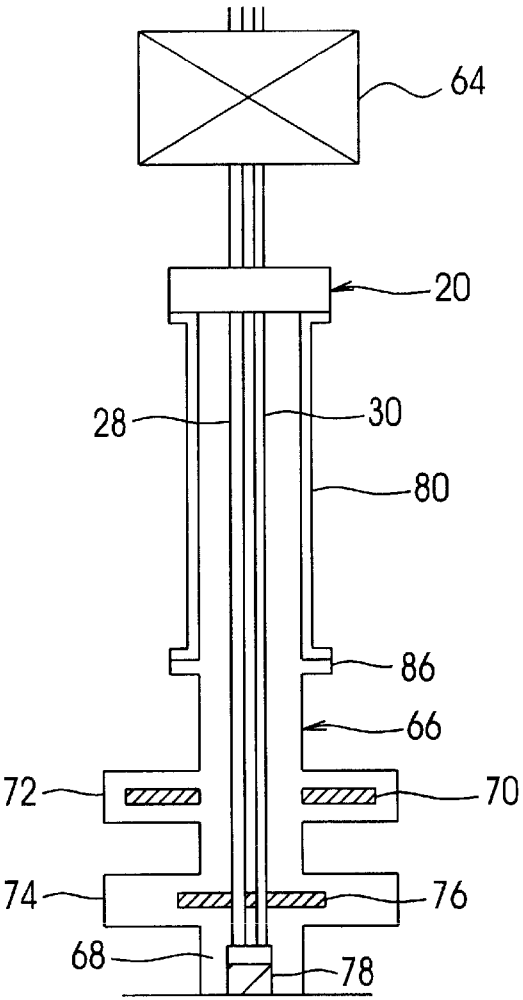
Figure 6:
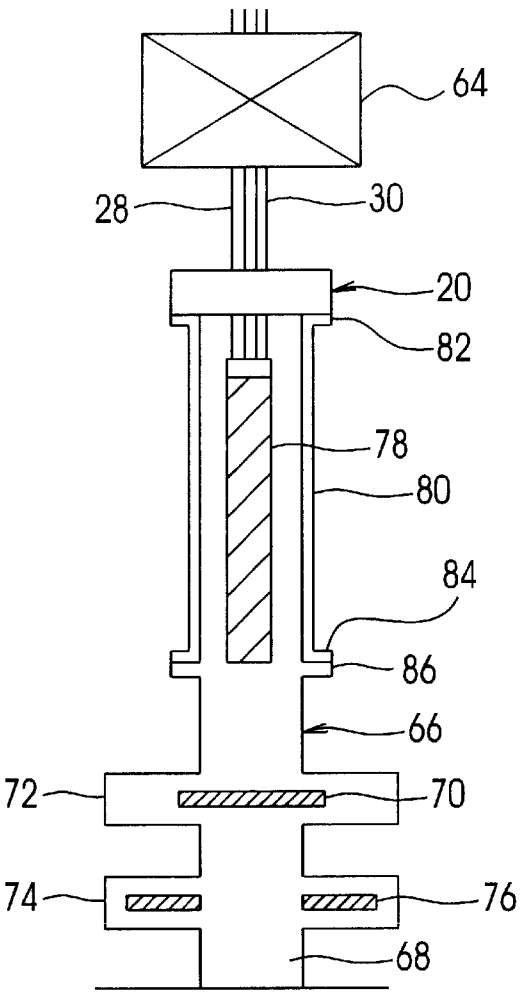
Figure 5:
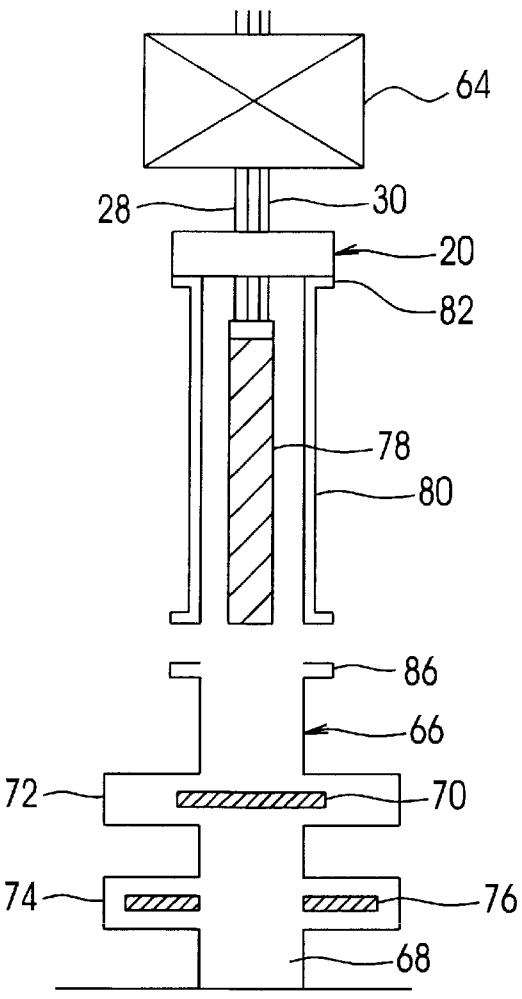

As shown in FIG. 4, a downhole tool 78 is connected to the first and second coil tubing strings 28. A lubricator 80, having opposed open ends, as illustrated in FIG. 5, is positioned over the downhole tool 78. The lubricator 80 is sealingly connected at its top flange 82 to the seal assembly 20. After the lubricator 80 is sealingly connected to the seal assembly 20, the first and second coil tubing strings 28 and 30 are driven further through the tubing string injector assembly 64 to lower the downhole tool 78 and the lubricator 80 until a bottom flange 84 of the lubricator 80 rests on the top flange 86 of the wellhead 66 as shown in FIG. 6. The lubricator 80 is sealingly connected to the wellhead 66 so that a sealed chamber is provided between the closed blind rams 70 of the blowout preventer 72 and the seal assembly 20 to sealingly contain the downhole tool 78 therein. At this stage any pressure difference between above and below the closed blind rams 70, is balanced by a pressure bleed device (not shown), and then the blind rams 70 are opened to permit the downhole tool 78 to be inserted downwardly therethrough for a downhole operation. Before the downhole tool 78 is continuously injected downwardly in the well bore 68, lubricant should be pumped at a slow rate through supply lines (not shown) connected to the respective lubrication ports 50 and 54 (see FIG. 1) to lubricate the annular seals 36 and 44. The lubricant supply lines can be connected to the seal assembly 20 at any time before the downhole tool 78 is continuously injected into the well bore 68. Nevertheless, it is preferably done when the seal assembly 20 and the lubricator 80 are secured to the top of the wellhead 66, as shown in FIG. 6. If a dual bore blowout preventer 74 is required to be closed during a downhole operation, the pipe rams 76 can be closed to surround the respective first and second coil tubing strings 28 and 30 at any time after the downhole tool 78 is inserted below the dual bore blowout preventer 74, as shown in FIG. 7.

Alternatively, the lubricator 80 may be installed on the wellhead 66 by sealingly connecting the bottom flange 84 to the top flange 86 of the wellhead 66 (see FIG. 6) if the dual string coil tubing injector assembly 64 is supported high enough above the wellhead 66 so that the downhole tool 78 connected to the first and second coil tubing strings 28 and 30 is above the top flange 82 of the lubricator 80. The well tool 78 is inserted into the lubricator 80 until the seal assembly 20 mates with the top flange 82 of the lubricator 80 as shown in FIG. 6. The lubricator 80 is not required if the downhole tool is shorter than a space between the blind rams 70 and the top flange 86 of the wellhead 66, or the downhole operation requires only the first and second coil tubing strings 28 and 30.

Figure 8:
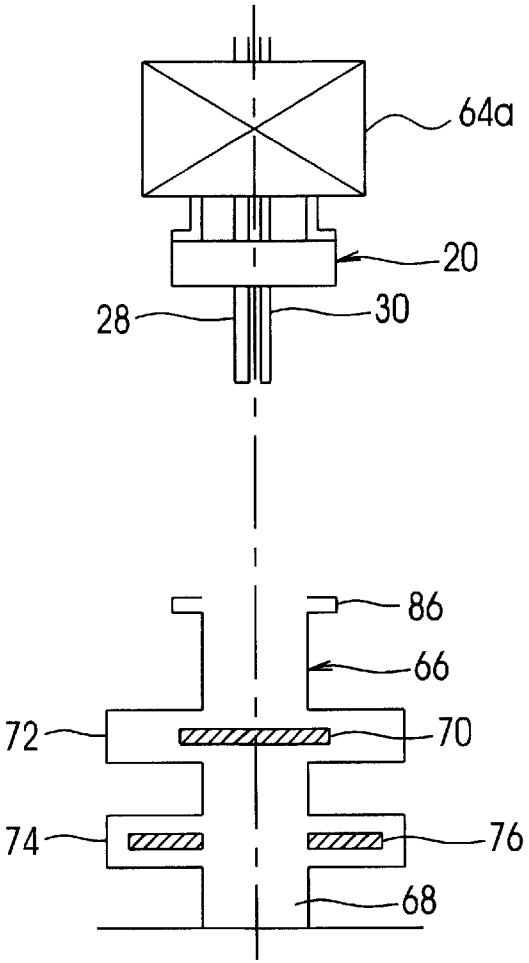

As shown in FIG. 8, a dual string coil tubing injector assembly **64*a* may be secured to the top of the seal assembly 20. The combination of the dual string coil tubing injection assembly 64*a* and the seal assembly 20 is suspended by a rig or crane (not shown) over the wellhead 66 and aligned with the well bore 68. The first and second coil tubing strings 28 and 30 are inserted through the dual string coil tubing injector assembly 64*a* and the seal assembly 20, which may be done before the dual string coil tubing injector assembly 64*a* and the seal assembly 20 are suspended over the wellhead 66**.

Figure 10:
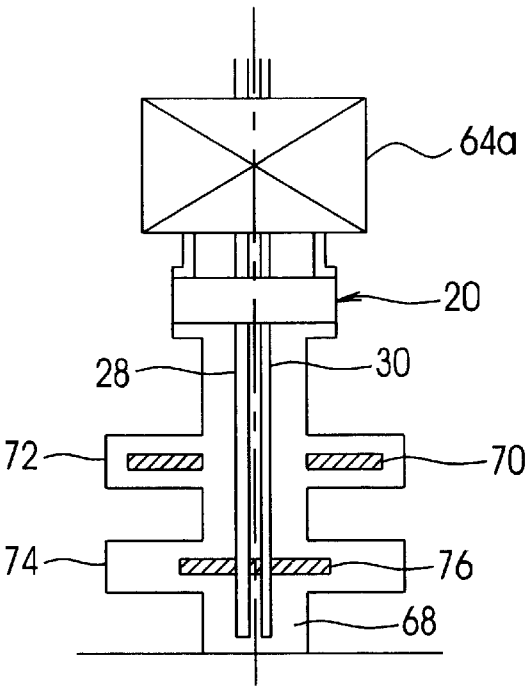
FIGS. 8–10 are schematic diagrams, illustrating a method of using the seal assembly shown in FIG. 1 to inject first and second coil tubing strings without a downhole tool, into the well bore.
Figure 9:
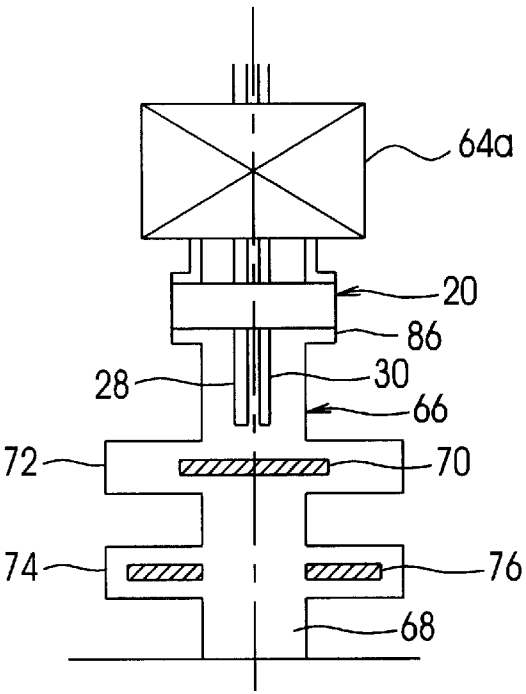

The combination of the dual string coil tubing injector assembly **64*a* and the seal assembly 20 is lowered until the seal assembly 20 rests on the top flange 86 of the wellhead 66, as shown in FIG. 9. The blind rams 70 of the blowout preventer 72 are closed so that a sealed chamber is created between the blind rams 70 and the seal assembly 20 that contains the free ends of the first and second coil tubing strings 28 and 30 when the seal assembly 20 is sealingly connected to the top flange 86 of the wellhead 66. After a pressure difference above and below the blind rams 70 is balanced, the blind rams 70 are opened and lubricant is slowly pumped into the seals 36 and 44 (see FIG. 1) to permit the first and second coil tubing strings 28 and 30 to be injected into the well bore, as required for a specific downhole operation. The pipe rams 76 of the dual bore blowout preventer 74 can be closed to surround the respective first and second coil tubing strings 28 and 30 after the free ends of the first and second coil tubing strings 28 and 30 are inserted below the dual bore blowout preventer 74, as shown in FIG. 10. Thereafter, the first and second coil tubing strings 28 and 30 can be injected synchronously or asynchronously depending on the requirements of a particular downhole operation. The steps of the process are reversed to extract the coil tubing strings 28 and 30 from the well bore 68. Those skilled in the art will understand that downhole tools or other equipment such as temperature or pressure sensors may be connected to either one of the first and second coil tubing strings 28 and 30, as required for any particular well servicing operation. Use of a lubricator 80 is dictated by the axial length of the downhole tool 78** required for a particular job.

The forgoing description is intended to be exemplary rather than limiting. The scope of the invention is therefore intended to be limited solely by the scope of the appended claims.

I claim:

1. A seal assembly for dual string coil tubing injection into a subterranean well comprising:

a seal plate adapted to be connected to a wellhead, the seal plate having a top surface and a bottom surface;

a first bore extending through the seal plate between the top and bottom surfaces, the first bore retaining a first annular seal adapted to provide a high-pressure fluid seal around a first coil tubing string inserted therethrough;

a second bore extending through the seal plate between the first and second surface, the second bore retaining a second annular seal adapted to provide a high-pressure fluid seal around a second coil tubing string inserted therethrough; and means for directing lubricant to the first and second annular seals to permit the annular seals to be respectively lubricated when the respective first and second coil tubing strings are injected into and extracted from the wellhead.

2. A seal assembly as claimed in claim 1 wherein the seal plate is adapted to be mounted directly to a top of the wellhead.

3. A seal assembly as claimed in claim 1 wherein the seal plate is adapted to be mounted to a top of a lubricator that is connected to a top of the wellhead.

4. A seal assembly as claimed in claim 1 wherein each of the first and second bores comprises a first section having a diameter slightly greater than the corresponding coil tubing string inserted therethrough, and a packing chamber having a diameter greater than the diameter of the first section for retaining the annular seal.

5. A seal assembly as claimed in claim 4 wherein the respective packing chambers of the first and second bores comprise retainer nuts for retaining the respective first and second annular seals in the packing chambers.

6. A seal assembly as claimed in claim 4 wherein the means for directing lubricant to the first and second annular seals comprises a first port with a radial passage in fluid communication with the packing chamber in the first bore, a second port with a radial passage in fluid communication with the packing chamber of the second bore, the respective first and second ports being adapted for connection of a pressurized lubricant source.

7. A seal assembly as claimed in claim 2 wherein the seal plate comprises a recess for retaining an annular seal between the top end of the wellhead and the bottom surface of the seal plate.

8. A method of preventing fluid leakage during injection of first and second tubing strings into a subterranean well, comprising steps of:

inserting the first and second coil tubing strings through respective annular seals in a seal plate;

suspending the seal plate and the first and second coil tubing strings over a wellhead installed on the well;

providing a sealed chamber between the seal plate and a closed blind ram of a blowout preventer of the wellhead;

opening the blind ram of the blowout preventer; and injecting the first and second coil tubing strings using a dual string coil tubing injector while slowly pumping lubricant to the annular seals in the seal plate.

9. A method as claimed in claim 8 wherein prior to the "providing" step, a downhole tool is connected to a free end of at least one of the first and second coil tubing strings, and the sealed chamber provided in the "providing" step sealingly contains the downhole tool.

10. A method as claimed in claim 8 wherein the "providing" step comprises:

lowering the seal plate and inserting free ends of the first and second coil tubing strings into the wellhead, until the seal plate rests on a top of the wellhead while the free ends of the first and second coil tubing strings remain positioned above a closed blind ram of the blowout preventer mounted to the wellhead; and sealingly connecting the seal plate to the top of the wellhead.

11. A method as claimed in claim 9 wherein the "providing" step comprises sealingly connecting opposed open ends of a lubricator to the seal plate and a top of the wellhead, respectively, to provide the sealed chamber.

12. A method as claimed in claim 11 further comprising a step of inserting the downhole tool into the lubricator before sealingly connecting the open ends of the lubricator to the seal plate and a top of the wellhead.

13. A method as claimed in claim 9 wherein the downhole tool is connected to the free ends of both the first and second coil tubing strings.

14. A method as claimed in claim 8 wherein the dual string coil tubing injector is mounted to the seal plate before the seal plate and the first and second coil tubing strings are suspended over the wellhead.

15. A method as claimed in claim 14 wherein the dual string coil tubing injector is mounted to a frame before the first and second coil tubing strings are inserted through the injector.

16. A method of preparing a subterranean well for servicing, comprising the steps of:

inserting first and second coil tubing strings through fluid seals in a seal plate adapted to be connected to a top of a wellhead of the subterranean well;

connecting the seal plate to the top of the wellhead; and injecting the first and second coil tubing strings into the subterranean well to permit the well to be serviced using at least one of the first and second coil tubing strings as a conduit for delivering servicing fluids into the subterranean well.

17. The method as claimed in claim 16 further comprising a step of injecting the first and second coil tubing strings into the well bore using a dual coil tubing string injector.

18. The method as claimed in claim 16 further comprising a step of equalizing a pressure between a cavity between a blind ram of a blowout preventer connected to the wellhead and the seal plate before injecting the first and second coil tubing strings into the well.

19. A method as claimed in claim 18 further comprising a step of opening the blind rams after the pressure is equalized.

20. A method as claimed in claim 16 further comprising a step of slowly pumping lubricating fluid through lubricating ports in fluid communication with the seals in the seal plate to lubricate the seals as the first and second coil tubing strings are injected into the subterranean well.

* * * * *